US005370260A

United States Patent [19]

Paramski

[11] Patent Number: 5,370,260

[45] Date of Patent: Dec. 6, 1994

[54] DISPENSING FOOD CONTAINER AND COVER WITH VARIABLE SURFACE AREA

[76] Inventor: Walter P. Paramski, 31401 N. O Plain Rd., Libertyville, Ill. 60048

[21] Appl. No.: 990,619

[22] Filed: Dec. 14, 1992

Related U.S. Application Data

[63] Continuation-in-part of Ser. No. 918,641, Jul. 21, 1992, Pat. No. 5,219,091.

[51] Int. Cl.[5] ..... B65D 83/00

[52] U.S. Cl. ..... 220/580; 222/320; 222/386

[58] Field of Search ..... 220/216, 219, 221, 222, 220/224, 227, 287, 352, 578, 579, 580; 222/319, 320, 386, 386.5, 387

[56] References Cited

U.S. PATENT DOCUMENTS

D. 276,118 10/1984 Conti et al. .
D. 287,919 1/1987 Clements .
1,603,013 10/1926 Bagley .
1,973,449 9/1934 Tighe .
2,309,446 1/1943 Ekkebus .
2,487,642 11/1949 De Waltoff ..... 220/320
2,684,791 7/1954 Sebell .
2,763,405 9/1956 Shvetz .
2,812,121 11/1957 Sheets .
2,915,225 12/1959 Atkins .
3,249,265 5/1966 Wershaw et al. .
3,987,941 10/1976 Blessing .
4,905,872 3/1990 Fischer .
5,037,009 8/1991 Shea .

*Primary Examiner*—Allan N. Shoap
*Assistant Examiner*—Nova Stucker
*Attorney, Agent, or Firm*—Speckman, Pauley & Fejer

[57] ABSTRACT

A dispensing food container having a bottom wall and a side wall connected to the bottom wall, thereby forming an inner chamber. A cover is displaceably mounted with respect to the side wall for varying the volume of the inner chamber. At least a portion of an outer peripheral portion of the cover forms a seal against an inner surface of the side wall. The cover has a cover through hole which is in communication with the inner chamber. A flanged nozzle can be used to facilitate transfer of the fluidized food from within the inner chamber to a cracker, a chip, a vegetable or the like.

16 Claims, 4 Drawing Sheets

DISPENSING FOOD CONTAINER AND COVER WITH VARIABLE SURFACE AREA

CROSS-REFERENCE TO RELATED APPLICATION

This is a continuation-in-part patent application of my co-pending patent application having Ser. No. 918,641, filed Jul. 21, 1992, U.S. Pat. No. 5,219,091.

BACKGROUND OF THE INVENTION

1. Field of the Invention

This invention relates to a container, particularly a tapered container, for dispensing food wherein a cover having variable surface area is forced toward a bottom of the container and results in a fluidized food being forced upward and through a through hole within the cover.

2. Description of Prior Art

Many food containers exist which hold fluidized food, such as various dips for chips, vegetables and the like. However, most conventional food containers require the user to scoop the food out with an utensil, such as a spoon, knife or the like. Other containers for food have various covers or lids for preserving the food during storage. Some conventional lids are for the purpose of retaining heat or preventing spillage of the fluidized food.

For example, U.S. Pat. Des. No. 287,919 discloses a drinking cup lid which has a relatively small through hole in the lid for allowing liquid within the drinking cup to flow from the cup, through the lid and into a special reservoir molded within the lid.

U.S. Pat. No. 2,812,121 teaches a dispensing container for liquids, powder, sugar and the like. The protective cover for the container has a flange with a cut away section. By squeezing or applying pressure about the periphery of the container, the container extends in a predetermined direction to form a spout through which liquid within the container can be poured. The spout extends through the cut away section of the lid when the container is compressed about its periphery.

U.S. Pat. Nos. 1,973,449 and Des. 276,118 disclose different covers for dishes or the like. According to the teachings of the '449 patent, the cover has openings for the exhaust of steam or vapor.

Many conventional food containers, particularly those having generally circular cross sections, are tapered from the top to the bottom. Such overall tapered shape of the container enables convenient and efficient stacking of multiple containers.

It is thus apparent that there exists a need for a container which provides easy dispensing of a fluidized food, such as dips for vegetables, chips, crackers and the like, particularly without requiring additional utensils for dispensing the food. It is apparent that there also exists a need for a cover that can accommodate the overall tapered shape of many conventional containers, so that a seal is maintained between the container and the cover as the cover is moved downward into the tapered container for dispensing the fluidized food.

SUMMARY OF THE INVENTION

It is one object of this invention to provide a tapered container with a cover that has a variable surface area, so that the cover can be displaced from the top of a tapered container to the bottom of the tapered container while maintaining a seal between the cover and the container.

It is another object of this invention to provide a container for dispensing food wherein a suitably designed flange is used to accommodate transfer of the fluidized food from the container to a chip, a cracker, a vegetable or the like.

It is still another object of this invention to provide a dispensing food container which prevents excessive spillage or waste of the food during the dispensing operation.

According to one preferred embodiment of this invention, a dispensing food container has a bottom wall and a side wall which is connected to the bottom wall, thereby forming an inner chamber. A cover is displaceably mounted with respect to the side wall for varying the volume of the inner chamber. At least a portion of an outer peripheral portion of the cover forms a seal against the inner surface.

In a preferred embodiment according to this invention, wherein the side wall of the container tapers from the top to the bottom of the container, the surface area of the cover can be varied. Thus, as the cover is forced along a tapered portion of the container, the surface area of the cover can increase or decrease to accommodate such tapered wall configuration while maintaining a seal between the cover and the side wall.

The variable surface area capabilities of the cover can be accomplished, according to one preferred embodiment of this invention, with a generally circular-shaped cover having a radial cut. The cover overlaps itself at the radial cut and thus the circumference therefore the area of the cover can be increased or decreased by adjusting the amount of overlap.

A guide wall is preferably secured to the cover near the radial cut. The overlap portion of the cover preferably slides between the guide wall and the cover. It is apparent that the guide wall can be positioned on the top surface or the bottom surface of the cover.

According to another preferred embodiment of this invention, the seal between the cover and the inner surface of the side wall is formed with a flexible sealing strip which is secured to and which extends radially outward from the outer peripheral portion of the cover. In another preferred embodiment according to this invention, the seal is formed by the cover having an oversized surface area and a reduced thickness, in a radially outward direction. The reduced thickness allows the cover to bend or flex upon the side wall of the container.

The cover has a cover through hole which is in communication with the inner chamber. The cover through hole preferably does not interfere with the overlap portion of the cover having variable surface area. The fluidized food flows from the inner chamber through the cover through hole when pressure is applied to the cover, so as to reduce the volume of the inner chamber.

According to one preferred embodiment of this invention, a nozzle is sealably secured to the cover. The nozzle has a nozzle opening which is in communication with the cover through hole. A flange is preferably secured to the nozzle. The flange has a flange through hole which is in communication with the nozzle opening and thus in communication with the inner chamber. It is apparent that the flange can be secured directly to or integrally formed with the cover so that the nozzle section is not necessary.

According to one preferred embodiment of this invention, a bottom insert is positioned within the inner chamber. The bottom insert preferably but not necessarily has a convex surface which is generally mateable with a generally concave inner surface of the cover. The concave inner surface of the cover faces the inner chamber. In one preferred embodiment of this invention, the bottom insert is integrally formed with the bottom wall. According to yet another preferred embodiment of this invention, the bottom insert has a male extension which is preferably aligned with and generally mateable within the cover through hole, for forcing all of the fluidized food out of the inner chamber, without wasting a portion of the fluidized food.

It is apparent that the components of this invention can be injection molded with a plastic or other polymeric material. It is also apparent that many basic components of this invention can be integrally formed with each other or can be separately formed and still accomplish the same result of this invention.

BRIEF DESCRIPTION OF THE DRAWINGS

This invention and the above and other objects of this invention will become more apparent when the specification is taken in view of the drawings, wherein.

DESCRIPTION OF PREFERRED EMBODIMENTS

Figure 1:
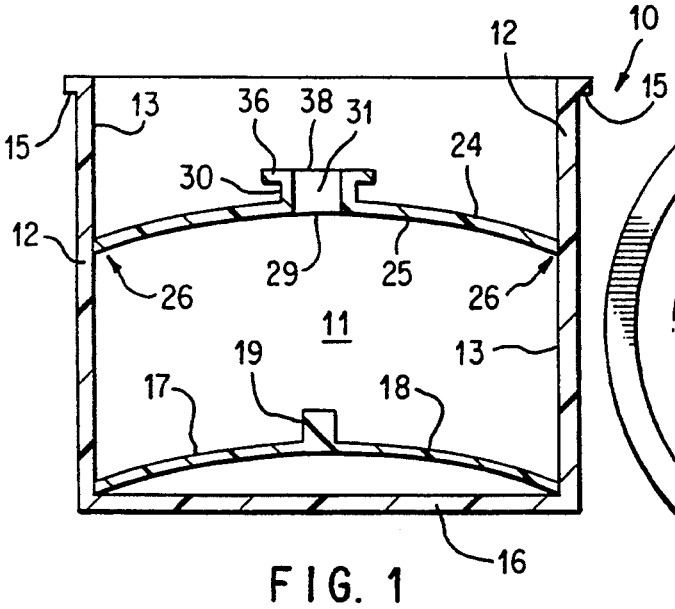
FIG. 1 is a cross-sectional view, taken through the center of a food dispensing container, according to one preferred embodiment of this invention.
Figure 2:
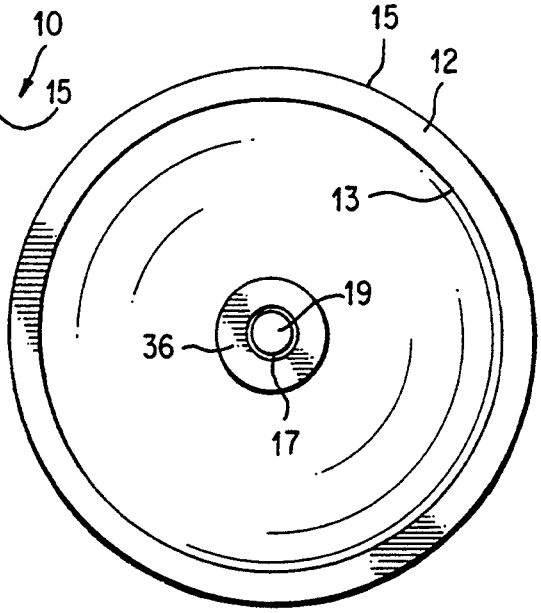
FIG. 2 is a top view of the food dispensing container, as shown in FIG. 1.

Referring to FIGS. 1 and 2, which show food dispensing container 10, according to one preferred embodiment of this invention, container 10 comprises side wall 12 which is connected to bottom wall 16, thereby forming inner chamber 11. It is apparent that side wall 12 and bottom wall 16 form a cylindrical container, as shown in FIG. 1. However, it is also apparent that side wall 12 and bottom wall 16 can form other suitably shaped containers which may not necessarily have either a circular cross-section or side walls that are perpendicular to the bottom wall. Side wall 12 has inner surface 13.

Cover 24 is displaceably mounted with respect to side wall 12. As shown in FIG. 1, cover 24 can move in a vertical direction, approximately parallel to side wall 12, for varying the volume of inner chamber 11. By reducing the volume of inner chamber 11, it is apparent that the fluidized food or other fluid within inner chamber 11 will find its path of least resistance and thus flow through cover through hole 29 of cover 24. Once the fluidized food is discharged from cover through hole 29, it is apparent that a chip, a cracker, a vegetable or the like can be used to scrape the fluidized food as it is discharged from cover through hole 29.

It is apparent that cover 24 preferably forms a seal with respect to inner surface 13, at outer peripheral portion 26 of cover 24. In one preferred embodiment according to this invention, cover 24 is sealed with respect to inner surface 25 about the entire periphery of cover 24. It is also apparent that according to other preferred embodiments of this invention, cover 24 need only be sealed with respect to inner surface 13 about a portion of the periphery of cover 24.

Cover 24 has at least one cover through hole 29 which is in communication with inner chamber 11. FIGS. 7A–7F show various embodiments of the possible configurations for cover through hole 29. It is apparent that other suitably shaped cover through holes 29 can be used at various positions about cover 24 to accomplish the same result of this invention, allowing fluidized food to pass from inner chamber 11 and through cover through hole 29.

In one preferred embodiment according to this invention, nozzle 30 is sealably secured to cover 24. Nozzle 30 has nozzle opening 31 which is in communication with cover through hole 29 and thus inner chamber 11. Flange 36, which defines flange through hole 38, is preferably secured to nozzle 30, such that flange through hole 38 is in communication with nozzle opening 31 and thus inner chamber 11. It is apparent that if and when used, flange 36 can be secured directly to cover 24 and thus eliminate the need for nozzle 30. According to one preferred embodiment of this invention, flange 36, cover 24, and when used, nozzle 30, are injection molded as one integral piece.

Figure 6:
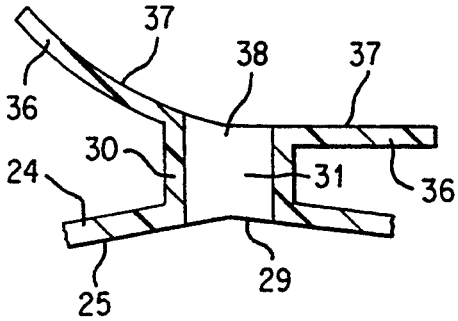
FIG. 6 is an enlarged cross-sectional view of a flange, a nozzle and the cover, according to one preferred embodiment of this invention.
Figure 7A:
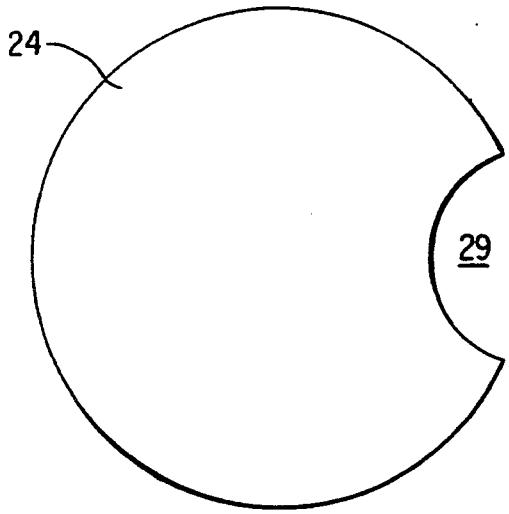
FIGS. 7A–7F each show a top view of a cover of this invention, each according to one preferred embodiment.
Figure 7B:
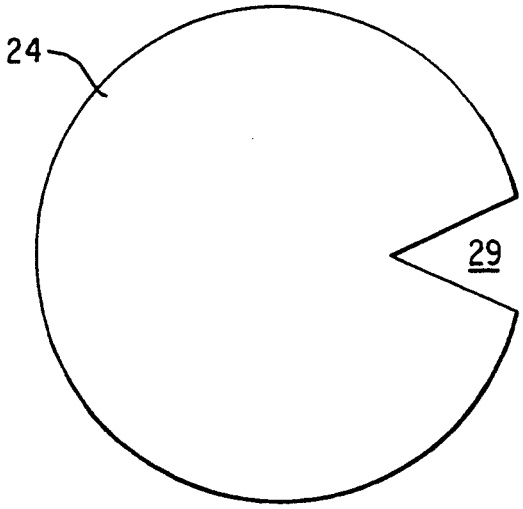
Figure 7C:
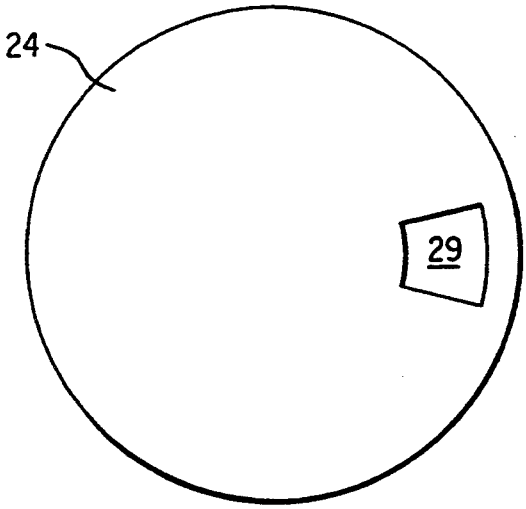
Figure 7D:
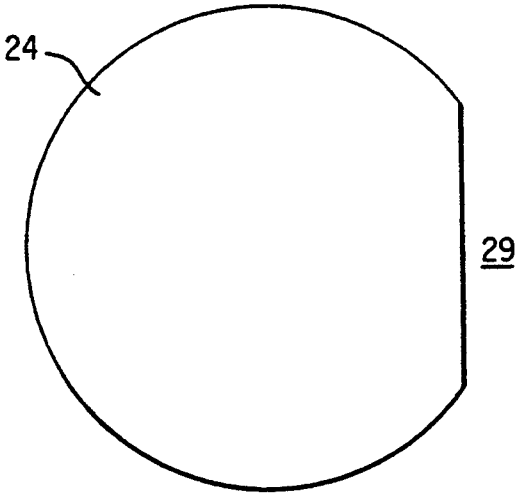
Figure 7E:
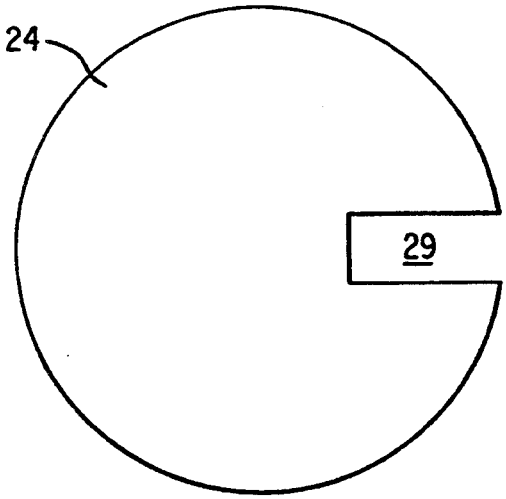
Figure 7F:
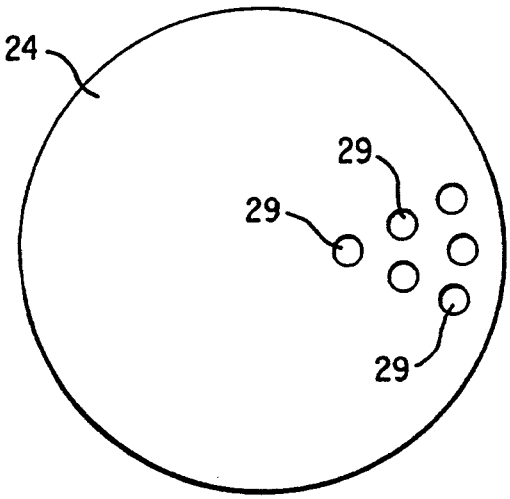

As shown in FIG. 6, flange 36 preferably forms scraping surface 37 in a concave fashion. Such concave surface facilitates transfer of the fluidized food from scraping surface 37 to the chip, cracker, vegetable or the like. However, it is apparent that any suitably shaped scraping surface 37 can be formed, depending upon the particular use of this invention.

Figure 3:
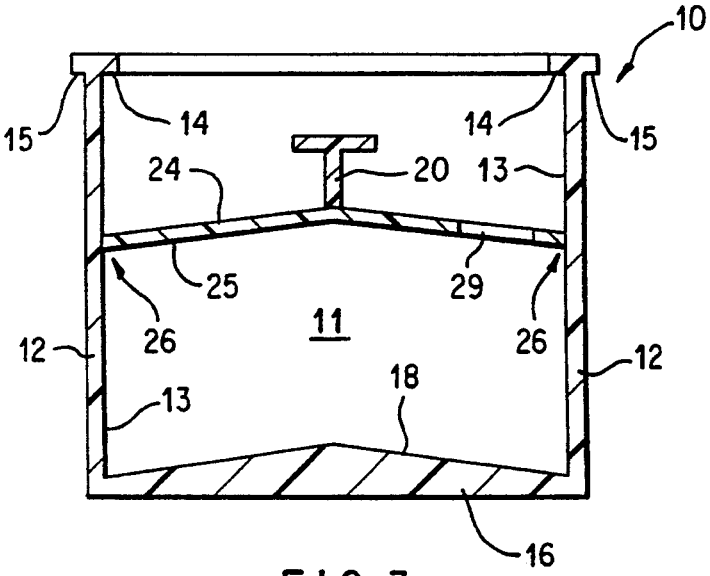
FIG. 3 is a cross-sectional view, taken along the center of a dispensing food container, according to another preferred embodiment of this invention.

According to one preferred embodiment of this invention, as shown in FIG. 1, bottom insert 17 is positioned within inner chamber 11. Bottom insert 17 preferably rests against bottom wall 16, as shown in FIG. 1. Bottom insert 17 preferably has generally convex surface 18, which is mateable with the generally concave inner surface 25 of cover 24. Thus, as cover 24 is pushed in a downward direction toward bottom insert 17, cover 24 and bottom insert 17 mate with each other to reduce the volume of inner chamber 11 as far as practically possible to remove as much of the fluidized food as possible. In one preferred embodiment according to this invention, bottom insert 17 and convex surface 18 are integrally formed with bottom wall 16, as shown in FIG. 3. In another preferred embodiment according to this invention, male extension 19 is aligned with and generally mateable within cover through hole 29. Such arrangement further facilitates removal of all of the fluidized food from within inner chamber 11.

It is apparent that male extension 19 can be integrally formed with either bottom insert 17 or bottom wall 16. It is also apparent that male extension 19 can be either integrally formed with or secured to bottom wall 16, for example. Although male extension 19 is shown only in FIG. 1 and not in FIG. 3, it is apparent that a suitably shaped male extension 19 can also be positioned within inner chamber 11, as shown in FIG. 3, to mate with cover through hole 29.

According to one preferred embodiment of this invention, sealing means are used to seal at least a portion of the peripheral edge of outer peripheral portion 26, with respect to inner surface 13 of side wall 12. In one preferred embodiment according to this invention, such sealing means comprise flexible sealing strip 28, as clearly shown in FIG. 4. Each flexible sealing strip 28 is secured to and extends radially outward from outer peripheral portion 26 of cover 24. It is apparent that each flexible sealing strip 28, whether one or more are used, can be secured to cover 24 with a suitable adhesive, by integrally forming such pieces, or by any other suitable connection means known to those skilled in the art. In another preferred embodiment according to this invention, the sealing means comprise outer peripheral portion 26 of cover 24 having reduced thickness 27, as clearly shown in FIG. 5. When using cover 24 with reduced thickness 27, cover 24 preferably has an oversized surface area so that peripheral portion 26 overlaps upon and forms a seal against inner surface 13 of side wall 12. Regardless of whether the preferred embodiment of FIG. 4 or FIG. 5, or any other suitable arrangement, it is apparent that the same result of preventing the fluidized food from flowing between side wall 12 and cover 24 is accomplished.

As shown in FIG. 3, handle 20 is secured to cover 24. Handle 20 accommodates the application of force which is necessary to move cover 24 in a downward direction, toward either bottom wall 16 or bottom insert 17. As shown in FIGS. 1 and 2, outer lip 15 is formed about the upper edge of side wall 12, for accommodating any suitably shaped protective cover. As shown in FIG. 3, inner lip 14 is preferably used to prevent cover 24 from being completely withdrawn from container 10.

Regardless of the position of cover through hole 29 and the shape of cover 24 and its corresponding bottom wall 16 or bottom insert 17, this invention provides a simple and extremely sanitary apparatus for dispensing fluidized food, such as dips, cheeses and the like. It is also apparent that with either flange 36 or simply with the outer surface of cover 24, a cracker, chip, vegetable or the like can be used in lieu of a utensil, such as a spoon or the like, to transfer the fluidized food onto the chip, cracker, vegetable or the like.

According to other preferred embodiments of this invention, as shown in FIGS. 8A-15, container 110 further comprises means for varying the surface area of cover 124 as cover 124 is displaced with respect to side wall 112, in order to vary the volume of inner chamber 111. It is apparent that in FIGS. 8A-11, many of the elements are similar to those shown in FIGS. 1–7F. It is also apparent that many of such elements can be interchanged between such preferred embodiments of this invention.

Referring to FIGS. 8A, 8B, 8C and 9, such means for varying the surface area of cover 124 comprise cover 124 having a generally circular shape and radial cut 141 which extends from the center of cover 124 to a peripheral edge of cover 124. It is apparent that radial cut 141 is not necessarily required to extend from the precise center of cover 124 and is not necessarily required to extend along a linear path.

Figure 8A:
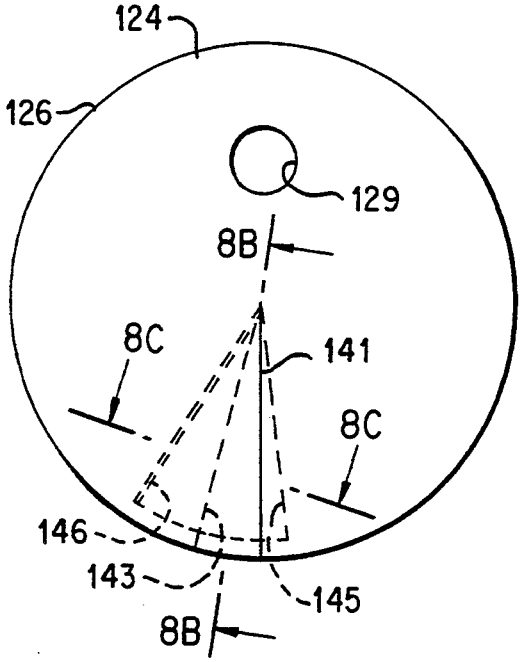
FIG. 8A is a top view of a cover having variable surface area, according to one preferred embodiment of this invention.
Figure 8B:
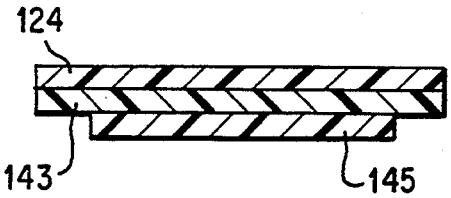
FIG. 8B is a partial cross-sectional view taken along lines 8B—8B, as shown in FIG. 8A.
Figure 8C:
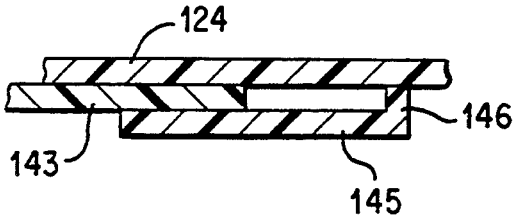
FIG. 8C is a partial cross-sectional view taken along line 8C—8C, as shown in FIG. 8A.

FIG. 8B shows an enlarged partial cross-sectional view taken along line 8B—8B as shown in FIG. 8A, and FIG. 8C shows an enlarged partial cross-sectional view taken along line 8C—8C, as shown in FIG. 8A. The drawings of FIGS. 8B and 8C are enlarged for clarification purposes. It is apparent that cover 124 is preferably constructed of a relatively thin polymeric or other suitable material so that the overlapping sections do not create an overall thickness according to the proportions shown in FIG. 9.

Figure 9:
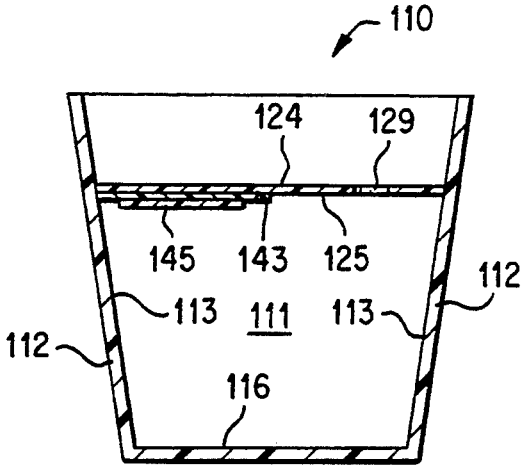
FIG. 9 is a cross-sectional view showing a tapered container and a cover having variable surface area, according to one preferred embodiment of this invention.

When inserted within container 110, as shown in FIG. 9, cover 124 preferably has overlap portion 143, as shown in FIG. 8A, which extends beneath cover 124 in an overlapping fashion. With such arrangement, the circumference and radius of cover 124 can be varied by sliding overlap portion 143 with respect to cover 124. It is apparent that having overlap portion 143 in an overlapping position with the remainder of cover 124, when cover 124 is in an at rest position, is preferred so that fluidized food does not escape through radial cut 141.

According to one preferred embodiment of this invention, guide means are used to guide overlap portion 143 as the surface area of cover 124 is varied by increasing or decreasing the circumference of cover 124. As most clearly shown in FIGS. 8A and 8C, such guide means may comprise guide wall 145 secured with respect to cover 124 by guide wall support 146. As shown in FIGS. 8A and 8C, overlap portion 143 is slidably mounted between cover 124 and guide wall 145. It is apparent that other suitable structures apparent to those skilled in the art can be used to maintain the preferred abutting relationship between cover 124 and overlap portion 143. Such abutting relationship is desired so that the fluidized food is prevented from flowing between cover 124 and overlap portion 143.

As shown in FIG. 8A, guide wall 145 preferably does not extend to either the center of cover 124 or the peripheral edge of cover 124.

Cover 124 having a variable surface area, according to this invention, is preferred for use in a tapered container wherein side walls 112 converge toward bottom wall 116. Thus, as cover 124 is displaced to vary the volume of inner chamber 111, a seal between cover 124 and side wall 112 is maintained so that the fluidized food flows along its path of least resistance, preferably through cover through hole 129. Cover through hole 129 is preferably positioned at a distance from radial cut 141 and at a distance from guide wall 145 and guide wall support 146, so that such structural elements do not interfere with fluidized food that may flow through cover through hole 129.

Figure 4:
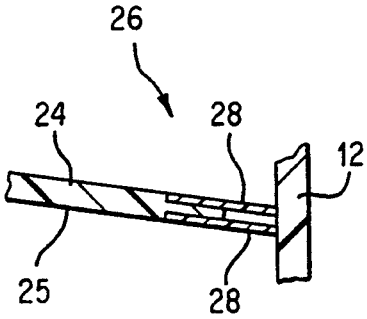
FIG. 4 is an enlarged cross-sectional view of a seal which is formed between a side wall and a cover of the food dispensing container.
Figure 5:
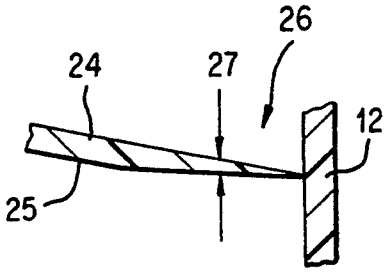
FIG. 5 is an enlarged cross-sectional view, of another preferred embodiment of the seal between the side wall and the cover.

It is apparent that according to the preferred embodiment of this invention as shown in FIGS. 8A-9, sealing means similar to those shown in FIGS. 4 and 5 can be used in combination with cover 124 and overlap portion 143 to achieve a proper seal between cover 124 and inner surface 113 of side wall 112. It is also apparent that other suitable seals can be used to accomplish the same result of preventing the flow of fluidized food between cover 124 and side wall 112.

Figure 10:
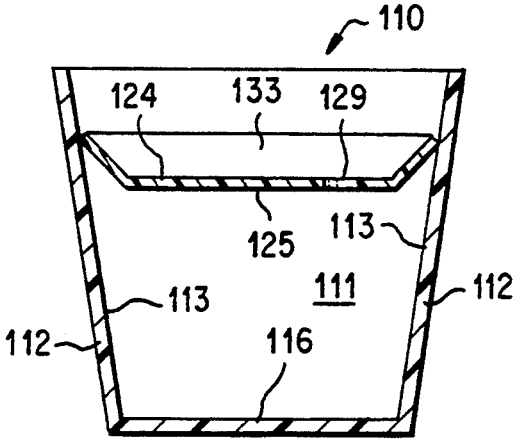
FIG. 10 is a cross-sectional view of a tapered container with a cover having variable surface area, according to another preferred embodiment of this invention.
Figure 11:
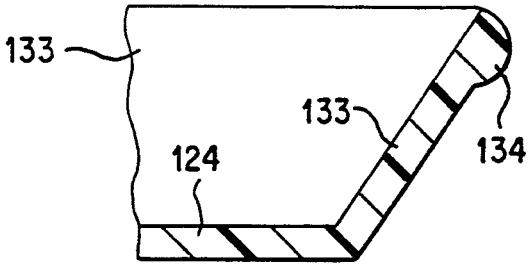
FIG. 11 is an enlarged view of a portion of the cover shown in FIG. 10.

FIGS. 10 and 11 show another preferred embodiment of cover 124, wherein the means for varying the surface area of cover 124, as cover 124 is displaced with respect to side wall 112, comprise cantilever rim 133. When a suitable material for cantilever rim 133 is selected, cantilever rim 133 is capable of flexing inward and outward with respect to side wall 112, as cover 124 is vertically displaced within container 110. The end portion of cantilever rim 133 preferably has contact portion 134, as clearly shown in FIG. 11, for forming a seal between cover 124 and side wall 112. It is apparent that contact portion 134 may be integral with cantilever rim 133 or may be a separate insert, such as a neoprene gasket or the like.

As shown in FIG. 10, when cover 124 is displaced, cantilever rim 133 deflects to effectively vary the surface area of cover 124. Thus as described in the specification and throughout the claims, such deflection by cantilever rim 133 is intended to relate to varying the surface area of cover 124.

Figure 12:
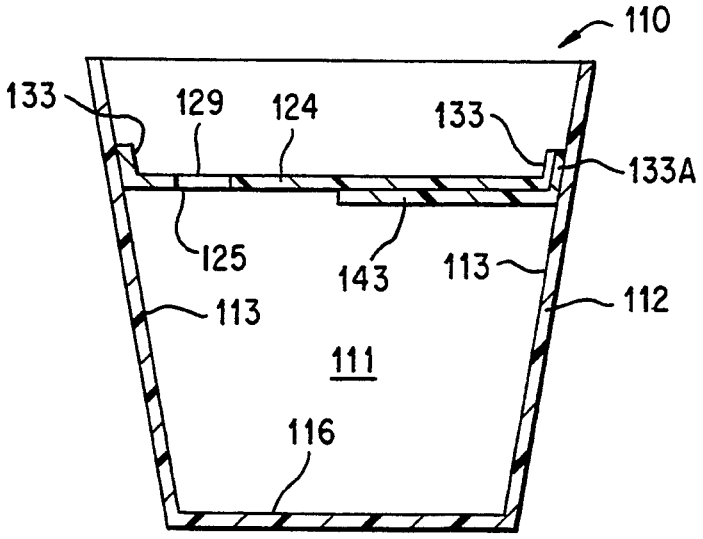
FIG. 12 is a cross-sectional view, taken along line 12—12 as shown in FIG. 13, of a tapered container with a cover having variable surface area, according to still another preferred embodiment of this invention.
Figure 13:
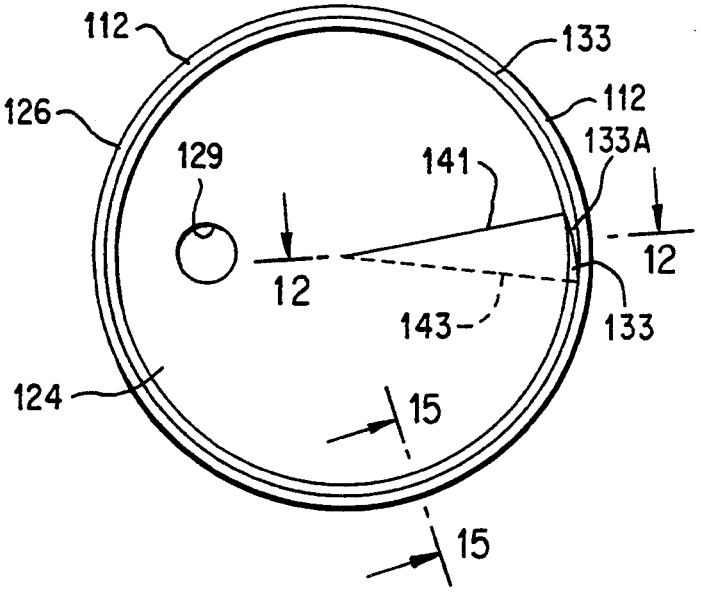
FIG. 13 is a top view of the container and cover, according to the preferred embodiment shown in FIG. 12.

FIGS. 12–15 show still another preferred embodiment of cover 124 positioned within side wall 112 of container 110. FIG. 13 shows a particularly important aspect of such preferred embodiment according to this invention, the overlapping tapered portions of cantilever rim 133 and 133A. As shown in FIG. 13, at the area where cover 124 overlaps itself, cantilever rim 133 and 133A have tapered end portions which mate with each other to effectively close all gaps between inner surface 113 and outer peripheral edge 126. As shown in FIG. 13, the tapered sections have relatively large angles. Depending upon the angle formed between side wall 112 and bottom wall 116 and/or depending upon the particular use of cover 124, such tapered sections can have a lesser or greater angle. The dashed line identified by element reference numeral 143 represents the terminal edge of the overlap portion of cover 124.

FIG. 12 shows a cross-sectional view which is taken along line 12—12, as shown in FIG. 13. As clearly shown in FIG. 12, the combined thickness of cantilever rim 133 and cantilever rim 133A, shown on the right side of FIG. 12, approximately equals the thickness of overlap portion 133, as shown on the left side of FIG. 12.

Although not shown in FIG. 12, it is apparent that guide wall 145 and guide wall support 146 can be used with such preferred embodiment of this invention, in order to guide overlap portion 143 as it moves relative to cover 124.

Figure 14:
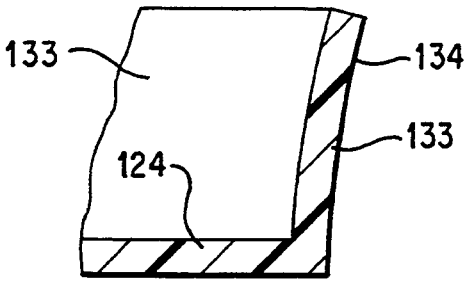
FIG. 14 is a partial cross-sectional view of an edge portion of a cover in a pre-stressed condition, according to one preferred embodiment of this invention.
Figure 15:
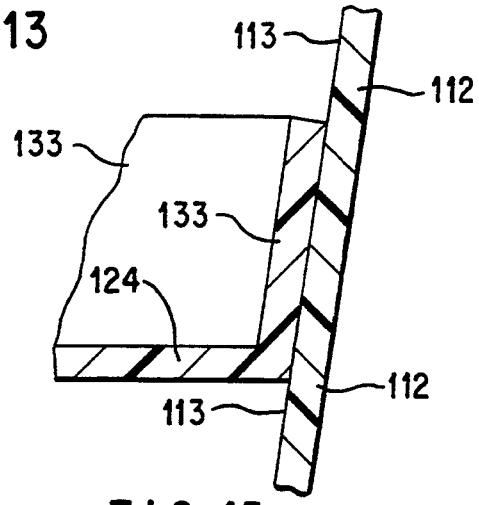
FIG. 15 is a cross-sectional view, taken along line 15—15 as shown in FIG. 13, of the end portion of the cover, as shown in FIG. 14, but shown in a mounted position within the container.

FIG. 14 shows an enlarged cross-sectional view of a portion of cover 124, according to the preferred embodiment as shown in FIGS. 12 and 13. As shown in FIG. 14, cover 124 is not positioned within container 110 and is preferably in a pre-stressed, at rest condition. As shown in FIG. 14, cantilever rim 133 flares outward so that when cover 124 is positioned within container 110, with contact portion 134 forming a seal against inner surface 113, cantilever rim 133 tends to be forced outward and thus maintain a tight seal against inner surface 113 as cover 124 is moved upward and downward within container 110.

During use within container 110 having converging side walls 112, cover 124 naturally tends to form a shallow cone structure when cover 124 is moved downward toward bottom wall 116. In order to effectively remove the fluidized food or other contents within inner chamber 111, it is apparent that an element similar to bottom insert 17, as shown in FIG. 1, can be used with the preferred embodiments of this invention as shown in FIGS. 8A-15.

It is apparent that bottom insert 17, handle 20, nozzle 30 and flange 36, and their associated elements, can be incorporated into the preferred embodiments of this invention as shown in FIGS. 8A-15. The components of this invention are preferably constructed from plastic or other polymeric material, since such materials can be injection molded at relatively low costs. However, it is also apparent that other suitable materials can be used for construction of the various components of this invention.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A dispensing food container comprising:

a bottom wall, a side wall connected to said bottom wall forming an inner chamber, said side wall having an inner surface;

a cover displaceably mounted with respect to said side wall for varying a volume of said inner chamber, at least a portion of an outer peripheral portion of said cover forming a seal against said inner surface, said cover having a cover through hole in communication with said inner chamber; and first means for varying a surface area of said cover as said cover is displaced with respect to said side wall to vary said volume of said inner chamber, said first means comprising said cover being generally circular and having a radial cut.

2. A dispensing container according to claim 1 wherein a cross-sectional area of said inner chamber converges toward said bottom surface.

3. A dispensing food container according to claim 1 wherein said side wall is integrally formed with said bottom wall.

4. A dispensing container according to claim 1 further comprising second means for guiding an overlap portion of said cover as said surface area of said cover is varied.

5. A dispensing container according to claim 4 wherein said second means comprise a guide wall secured to said cover near said radial cut, and a portion of said cover slidably positioned between said guide wall and said cover.

6. A dispensing container according to claim 5 wherein said cover through hole is at a first distance from said radial cut and at a second distance from said second means.

7. A dispensing food container according to claim 1 further comprising a nozzle sealably secured to said cover, said nozzle having a nozzle opening in communication with said cover through hole.

8. A dispensing food container according to claim 7 further comprising a flange secured to said nozzle.

9. A dispensing food container according to claim 1 further comprising third means for sealing at least a portion of a peripheral edge of said cover with respect to said inner surface.

10. A dispensing food container according to claim 9 wherein said third means comprise a flexible sealing strip secured to and extending radially outward from said outer peripheral portion of said cover.

11. A dispensing food container according to claim 9 wherein said sealing means comprise said outer peripheral portion of said cover having a reduced thickness in a radially outward direction.

12. A dispensing food container according to claim 1 wherein said first means comprise a cantilever rim about said cover, and sealing means for forming a seal between said cantilever rim and said inner surface.

13. A dispensing food container according to claim 12 wherein said sealing means comprise said cantilever rim having a contact portion positioned near an end of said cantilever rim.

14. A dispensing food container according to claim 12 wherein said cantilever rim is angled toward a top of said side wall, with respect to said cover.

15. A dispensing food container according to claim 12 wherein said sealing means comprise said cantilever rim being in a pre-stressed condition when at rest.

16. A dispensing food container according to claim 15 wherein said cantilever rim flares outward, away from a center of said cover, in a direction away from said cover.

* * * * *